United States Patent [19]

Puetz

[11] Patent Number: 4,821,970

[45] Date of Patent: Apr. 18, 1989

[54] IMPACT CRUSHER

[75] Inventor: Ronald G. Puetz, New Berlin, Wis.

[73] Assignee: Telsmith, Inc., Mequon, Wis.

[21] Appl. No.: 194,047

[22] Filed: May 13, 1988

[51] Int. Cl.[4] ..... B02C 13/28

[52] U.S. Cl. ..... 241/192; 241/294

[58] Field of Search ..... 241/189 R, 191, 192, 241/195, 197, 294

[56] References Cited

U.S. PATENT DOCUMENTS

| | | | |
|---|---|---|---|
| 2,747,803 | 5/1956 | Hanse | 241/191 |
| 3,531,055 | 9/1970 | Alt | 241/191 X |
| 4,573,643 | 3/1986 | Orphall et al. | 241/192 X |

FOREIGN PATENT DOCUMENTS

| | | | |
|---|---|---|---|
| 2347350 | 7/1974 | Fed. Rep. of Germany | 241/192 |

*Primary Examiner*—Mark Rosenbaum

*Attorney, Agent, or Firm*—James E. Nilles; Thomas F. Kirby

[57] ABSTRACT

An impact crusher rotor comprises radially slotted discs secured to a shaft at axially spaced intervals and hammer bars releasably secured in the disc slots. A backup bar secured in a slot in every disc provides a keyed connection with a hammer bar, at its rear, and a wedge in the slot maintains the hammer bar engaged against the backing bar with a force that increases with rotor speed. Each wedge can be established in an initial locking position by a screw that has its length radial to the rotor axis, has a threaded connection with the wedge, and has an end reacting against a bottom disc surface defined by the slot. Each wedge is confined to radial motion relative to the disc by a U-shaped shoe which straddles the disc periphery and is releasably fixed to the disc and which also protects a portion of the disc periphery that is in front of the hammer bar.

8 Claims, 4 Drawing Sheets

IMPACT CRUSHER

FIELD OF THE INVENTION

This invention relates to impact crushers wherein material to be crushed is impacted by front surfaces of elongated hammer bars carried for rapid orbital motion by a rotor structure that comprises discs which are fixed to a shaft at axially spaced intervals along it and which have radial slots wherein the hammer bars are seated with their lengths parallel to the rotor axis; and the invention is more particularly concerned with improved means in such a crusher for detachably securing the hammer bars to the discs.

BACKGROUND OF THE INVENTION

U.S. Pat. No. 3,151,816, which issued to Hanse et al in 1964, discloses an impact crusher of the general type to which this invention relates. The patent points out that the hammer bars on the rotor of such a device "are severely abused by the conditions under which the apparatus is operated", and that they should therefore be readily replaceable. It also points out that the hammer bars should nevertheless be securely locked to the rotor structure in such a manner that the high centrifugal and impact forces to which they are subjected do not loosen them and require them to be retightened from time to time. In the rotor that the patent discloses, the radial slot in which each hammer bar is seated defines opposing front and rear surfaces relative to the direction of rotor rotation, and the rear one of these slot-defined surfaces has a rearward undercut in which a rearward projection on the hammer bar is received for hook-like securement of the hammer bar against radially outward displacement by centrifugal force. For releasable locking of the hammer bar there is a wedge in the slot into which a screw is threaded that reacts against the front surface of the slot. Cooperating oblique surfaces in the slot, on the wedge and on the hammer bar translate the rearward force that the screw exerts on the wedge into a rearward and radially outward force on the hammer bar whereby the rearward projection on it is maintained firmly seated in the undercut and engaged against the radially inwardly facing abutment that the undercut defines.

A major disadvantage of this arrangement is that the hammer bar must necessarily be so configured that it can be installed in the rotor structure in only one position and orientation. Its impacting surface must project radially beyond the rotor structure periphery by a predetermined distance, and when that surface becomes excessively worn the hammer bar must be discarded and replaced, with no possibility of its being reversed or otherwise reoriented to bring another of its surfaces into use as an impact surface.

In U.S. Pat. No. 3,170,643, issued to Hanse et al in 1965 and disclosing another impact crusher of the general type here under consideration, very little is said about the manner in which the hammer bars are secured to the rotor structure other than that "they are releasably mounted in place as by means of wedges 21 so that they may be removed and replaced when wear has occurred." The drawings are sketchy and somewhat ambiguous with respect to the wedges, which appear to be so arranged that centrifugal force could throw them out of the rotor structure.

U.S. Pat. No. 3,531,055, issued to Alt in 1970, discloses a rotor structure wherein each hammer bar has longitudinally extending grooves in a pair of its opposite faces, those in one face being in laterally staggered relation to those in the other. For each hammer bar, a retaining beam that is welded to the discs of the rotor structure and extends along the rear of the hammer bar has a longitudinal rib which engages in any selected one of the longitudinal grooves to fix the hammer bar radially in relation to the discs. With this arrangement the hammer bar is reversible so that either of its faces can serve as its front material-impacting surface, and it can also be adjusted to project radially at different incremental distances beyond the peripheries of the discs that carry it. However, the hammer bar does not seem to be engaged against the retaining beam under clamping or wedging force. Instead, it is merely confined against radially outward displacement by the rib on the retaining beam and against lengthwise displacement by bolts through the retaining beam which engage in transverse grooves in the hammer bar but are so oriented that they cannot exert a clamping force against it. Since each hammer bar can be removed from the rotor structure only by withdrawing it lengthwise therefrom, the hammer bars must either fit rather loosely in the disc slots so that they tend to rattle against the discs and retaining beams or their installation and removal from the rotor structure must be very difficult.

U.S. Pat. No. 3,784,117, issued to Koenig in 1974, discloses a rotor wherein the hammer bars are confined in radial disc slots that define front and rear surfaces which are radially outwardly convergent and thus obliquely oppose one another. A support bar mounted in a recess in the rear surface of each slot has a forwardly protruding longitudinal rib which engages in a longitudinal groove in the rear face of the hammer bar. For each slot in each disc a radially outwardly tapering wedge is confined between the front face of the hammer bar and the front slot surface and is urged radially outwardly by a pressure fluid operated element. The radially outward force that the hydraulic devices exert upon the wedges is translated by the latter into a rearward clamping force upon the hammer bar that maintains it firmly but releasably engaged with the support bar. The obvious disadvantage of this arrangement is that its hydraulic apparatus is complicated, expensive and not well suited to the rigors of an impact crusher environment.

U.S. Pat. No. 4,573,643, issued to Orphall et al in 1986, discloses a rotor having, for each hammer bar, a backup bar of circular cross-section which is secured to the rear of the disc slot that receives the hammer bar and which engages in a longitudinally extending arcuate groove in the hammer bar to fix the radial position thereof. In this case, too, a radially outward tapering wedge member in the disc slot confines the hammer bar against the backup bar. To restrict the wedge to radially in and out motion in the disc slot, a U-shaped clamping member straddles the peripheral portion of the disc and has legs that normally embrace the wedge. A bolt extends lengthwise parallel to the rotor axis through the wedge and the legs of the clamping member to constrain the wedge and clamping member to move as a unit in directions radial to the rotor axis. When the machine is in operation, centrifugal force maintains each wedge in secure clamping engagement with its hammer bar whereby the latter is in turn firmly confined against its backup bar; but some difficulty is involved in establishing the wedges initially in firm engagement with newly installed hammer bars so that they will be securely held in place during the first few slow revolutions of the rotor. For installation of a hammer bar the disc slots that are to receive it must be in or near the 3 o'clock position of rotor rotation, and to accommodate this limitation the rotor must be releasably locked against rotation out of that position.

U.S. Pat. No. 4,679,740, issued to Orphall in 1987, discloses a rotor wherein a circular-section backup bar cooperates with each hammer bar and with a wedge, essentially as in the above-discussed Orphall et al patent, but no U-shaped clamping member is needed because the wedge has ridges or lands which slidingly engage the axially opposite surfaces of the disc to confine the wedge against displacement parallel to the rotor axis. In addition, the radially inner portion of the wedge has side surfaces which are flush with the axially opposite side surfaces of the disc and which are overlain by a pair of plates that also overlie the side surfaces of the disc. These plates are connected with one another by means of a bolt that is lengthwise parallel to the rotor axis and extends through an enlargement or bay near the radially inner end of the disc slot. A sleeve around this bolt is selected to have an outside diameter such as to take up any clearance between the bottom of the bay and the wider radially inner end of the wedge, to establish the wedge in wedging engagement with the hammer bar immediately upon installation. The disadvantage of this arrangement is that small tolerances cannot very well be maintained in a rotor structure of the type here under consideration, so that the outside diameter of the sleeve tends to vary from wedge to wedge and therefore a sleeve of the required outside diameter must be found or made for each wedge. This arrangement also seems to require that the rotor be releasably locked against rotation for installation of each hammer bar.

From the foregoing brief review it will be apparent that securement of the hammer bars of an impact crusher rotor presents a complex set of requirements that have not heretofore ben fully satisfied. Thus, it has not been obvious to those working in the art how to provide simple, sturdy and inexpensive means for firmly but readily detachably securing the hammer bars to the rotor structure in an arrangement such that the hammer bars are both reversible and radially adjustable, are well supported against high impact and centrifugal forces by rotor structure that is both light and inexpensive, and can be quickly and easily installed, adjusted and removed.

SUMMARY OF THE INVENTION

The general object of the present invention is to provide an impact crusher rotor structure of the type described above which fully satisfies all of the requirements that will be apparent from the foregoing discussion of the prior art, but which nevertheless has none of the several disadvantages involved in the prior arrangements.

A more specific object of the invention is to provide an impact crusher rotor that comprises radially slotted discs fixed to a shaft at axially spaced intervals along it and elongated hammer bars that are received in the disc slots and are readily detachably secured to the discs in such a manner that each hammer bar is both reversible and radially adjustable, is well supported against both centrifugal and impact forces, and is assuredly confined against rattling.

Another specific object of the invention is to provide simple, compact and efficient means for securing hammer bars to the rotor structure of an impact crusher whereby the above-stated objects are fully met, the hammer bars can be quickly and easily installed, adjusted and removed, and the hammer bars are initially securely locked to the rotor structure and tend to be clamped more firmly against the rotor structure, for confinement against rattling, by centrifugal force due to rotor rotation.

It is also a specific object of the invention to provide hammer bar securement means in an impact crusher rotor that comprises wedges for each hammer bar whereby the hammer bar is confined against a backing bar behind it that extends lengthwise along the hammer bar and supports the centrifugal and impact forces upon it, the securement means further comprising a screw for each wedge which has a threaded connection with its wedge that provides for preliminary wedge locking of the hammer bar during installation, said screw, however, being so arranged that it can loosen during operation of the machine without in any wise affecting the security of the hammer bar locking.

Having in mind that the discs of the rotor structure are made of a relatively soft metal and are thus subjected to substantial abrasive wear when the crusher is in operation, it is another specific object of the invention to provide hammer bar securement means comprising simple and inexpensive shoes of relatively hard material which substantially confine the wedges against displacement in directions parallel to the rotor axis and which also serve the important function of protecting the most vulnerable portions of the discs and of other elements of the hammer bar securement means.

These and other objects of the invention that will appear as the description proceeds are achieved in the impact crusher rotor assembly of this invention, which comprises a shaft mounted for rotation in one direction about a rotor axis, at least one disc fixed to the shaft for rotation with it and which has a peripheral surface, opposite side surfaces normal to said axis and a slot opening substantially radially outwardly to said peripheral surface and defining on the disc a radially outwardly facing bottom surface and opposing front and rear confining surfaces that extend substantially radially outward from said bottom surface, an elongated hammer bar received in said slot and extending lengthwise parallel to said axis, said hammer bar having a front surface facing substantially in said direction which projects radially outwardly beyond the peripheral surface of the disc to provide a material impacting surface and relative to which the front confining surface on the disc is in obliquely opposing and radially outwardly convergent relationship, cooperating key means on the disc and on the rear of the hammer bar providing radially oppositely facing abutments opposingly engageable to confine the hammer bar against radially outward displacement relative to the disc, and a radially outwardly tapering wedge in said slot which is confined between said front surface of the hammer bar and said front confining surface on the disc and which cooperates with said key means to releasably lock the hammer bar to the disc. The rotor assembly of this invention is characterized by a screw extending lengthwise substantially radially to the rotor axis, which screw has one end rotatably engaging said bottom surface on the disc to react against the same and has a threaded connection with the wedge whereby rotation of the screw in one direction drives the wedge radially outwardly in the slot and thus into confining engagement with the hammer bar whereby the abutments of the key means are maintained engaged, rotation of the screw in the opposite direction providing for release of the wedge so that the hammer bar can be removed from the slot.

Preferably the wedge has side surfaces which are substantially flush with said side surfaces of the disc. A substantially U-shaped shoe that straddles the disc has a pair of opposite legs which flatwise overlie said side surfaces of the disc and of the wedge to confine the wedge against displacement relative to the disc in directions parallel to the rotor axis and has a bight portion by which the legs are connected and which protectively overlies the peripheral surface of the disc in a zone thereof that is in front of the front surface of the hammer bar. The shoe is releasably fixed to the disc by securement means engaged with the disc and with the legs of the shoe, so that centrifugal force can displace the wedge radially outwardly relative to both the disc and the shoe.

Other features which characterize preferred embodiments of the invention will appear from the following description.

BRIEF DESCRIPTION OF THE DRAWINGS

In the accompanying drawings, which illustrate what are now regarded as preferred embodiments of the invention.

DETAILED DESCRIPTION OF PREFERRED EMBODIMENTS OT THE INVENTION

Figure 1:
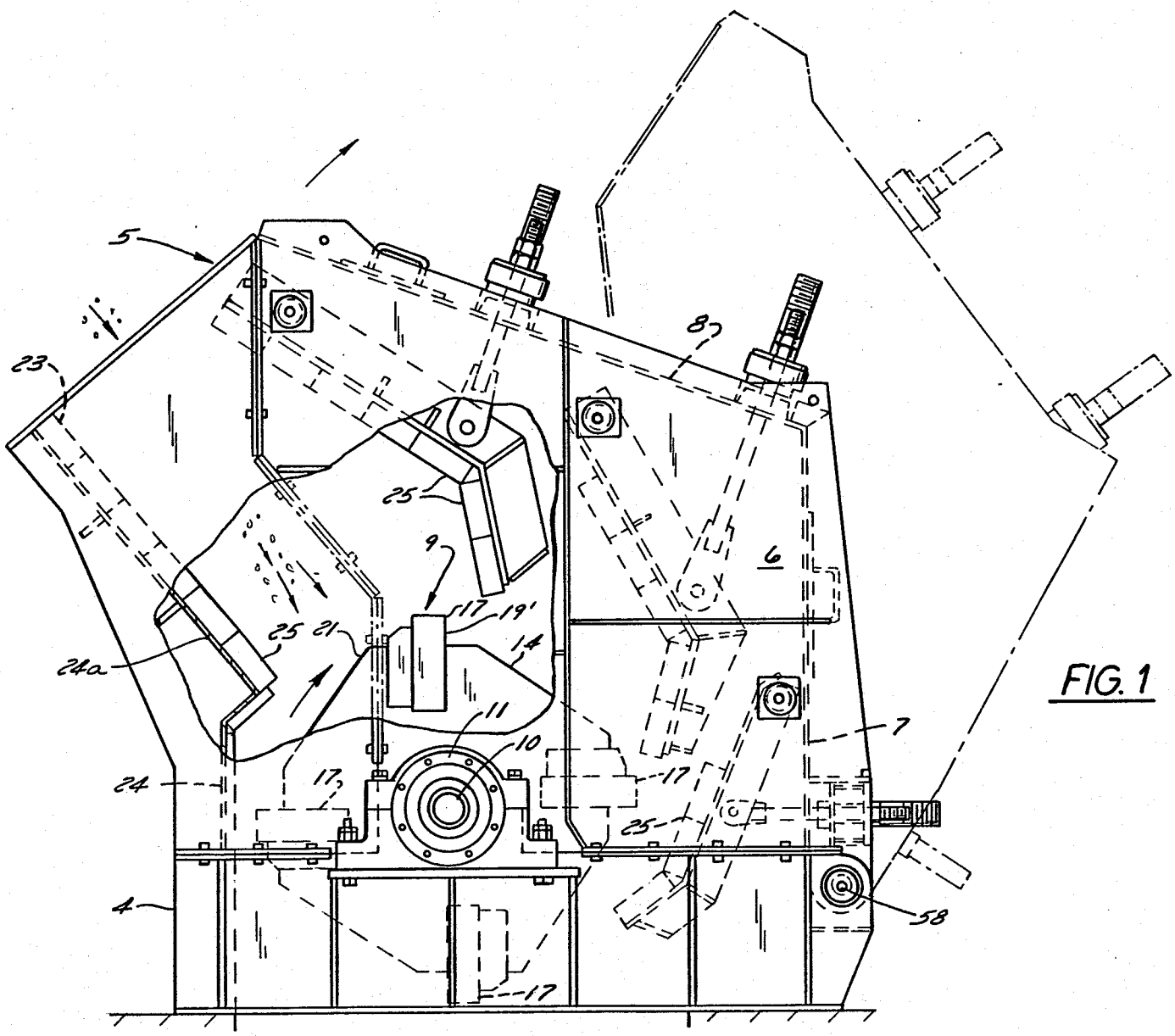
FIG. 1 is a view in side elevation, with portions shown broken away, of an impact crusher embodying the principles of this invention.

An impact crusher of the type to which the invention relates comprises a housing 5 having opposite upright side walls 6, a substantially upright front wall 7 and a top wall 8. Inside the housing is a rotor 9 comprising a horizontal shaft 10 rotatably supported in bearings 11 that are mounted on side portions of the base frame 4 of the crusher. Fixed to the shaft 10, preferably at the exterior of the housing, is a pulley (not shown) or the like whereby the rotor 9 is driven for rapid rotation in one direction, clockwise as seen in FIG. 1. The rotor 9 further comprises a number of sturdy, preferably identical discs 14 which are fixed to the shaft 10 at axially spaced intervals along it and each of which has a plurality of radially outwardly opening slots 15 wherein elongated hammer bars 17 are seated. Each hammer bar 17 extends lengthwise parallel to the rotor shaft 10 and is supported by at least two of the discs 14, being releasably locked into a slot 15 in each of those discs as described hereinafter.

Each of the hammer bars 17 has a front surface 19 which faces in the direction of rotor rotation and which extends radially outwardly beyond the peripheries 21 of the discs 14 that support it to provide an impact surface 19'. Material to be crushed is charged into the housing 5 through an inlet opening 23 in its top, near the rear of the housing. The rear wall 24 of the housing has a downwardly and forwardly inclined upper portion **24*a* along which the incoming material is guided towards a sector of the rotor where the hammer bars 17 are moving upwardly and forwardly. Forcefully impacted by the hammer bars, the material is thrown by them into further impacting engagement against one or more substantially vertical breaker plates 25 that are suspended from the top wall 8 of the housing in a generally known arrangement, and the material is comminuted by such repeated impacts. The hammer bars 17 are made of especially hard material so that their impact surfaces 19'** will have reasonable resistance to abrasive erosion.

To facilitate manufacture the discs 14 are made of softer material than the hammer bars. Each of the discs has substantially flat opposite side surfaces 26 that are normal to the rotor axis and has substantial thickness between those surfaces. Each slot 15 in a disc thus defines on the disc a radially outwardly facing bottom surface 28 that has a radially outwardly stepped-up rear portion **28*a*, a rear confining surface 29 which faces substantially in the direction of rotation and extends radially outwardly from the stepped-up rear portion 28*a* of the bottom surface, and a front confining surface 30 that faces substantially oppositely to the direction of rotation and extends radially outwardly from the front of the bottom surface 28. Received in the rear portion of each slot 15 is an elongated backing bar 32** which extends the full axial length of the rotor and which is welded or otherwise rigidly secured to every disc of the rotor.

Each hammer bar 17 is disposed in front of a backing bar 32, in firm engagement with a flat front surface 33 on the backing bar to be supported and reinforced by it and to have a keyed connection with the backing bar whereby the hammer bar is maintained in a predetermined position with its impact surface 19' projecting radially a predetermined distance beyond the disc peripheries. As here shown, and as is preferred, the keyed connection comprises lengthwise extending ribs **34*a*, 34*b* on the hammer bar and a pair of lengthwise extending grooves 35 in the flat front surface of the backing bar. A radially outwardly tapering wedge 36 in each disc slot, confined between the front confining surface 30 on the disc and the front surface 19 of the hammer bar, maintains the hammer bar engaged under clamping force against the front surface 33** of the backing bar.

Figure 2:
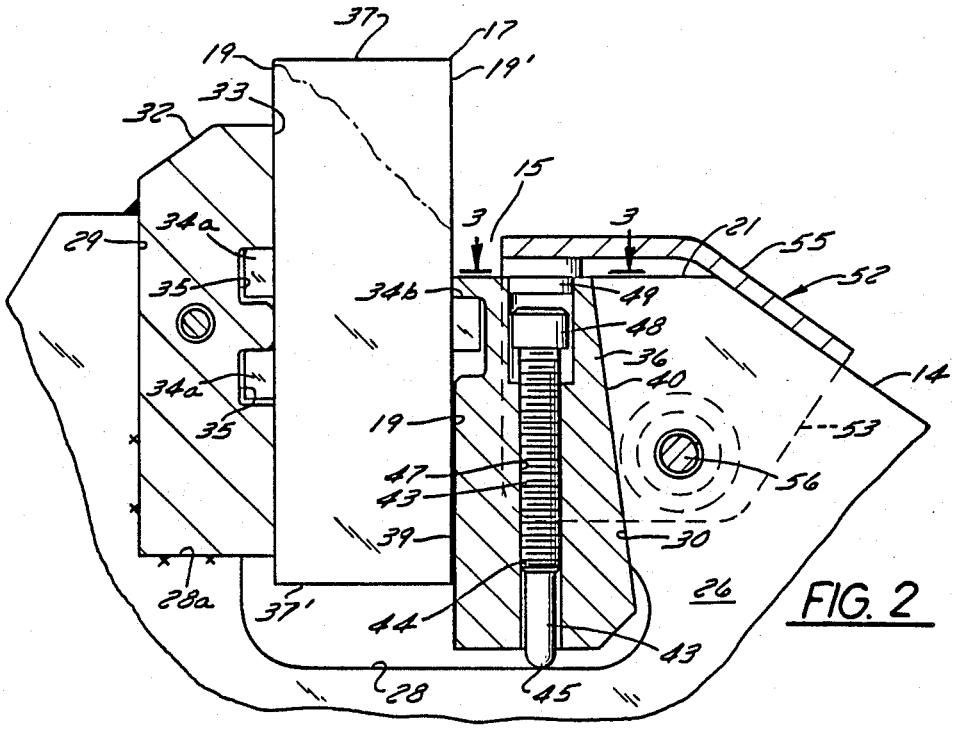
FIG. 2 is a detail view in vertical section of a portion of the rotor, showing one of the hammer bars and the means for securing it to a disc of the rotor structure.
Figure 4:
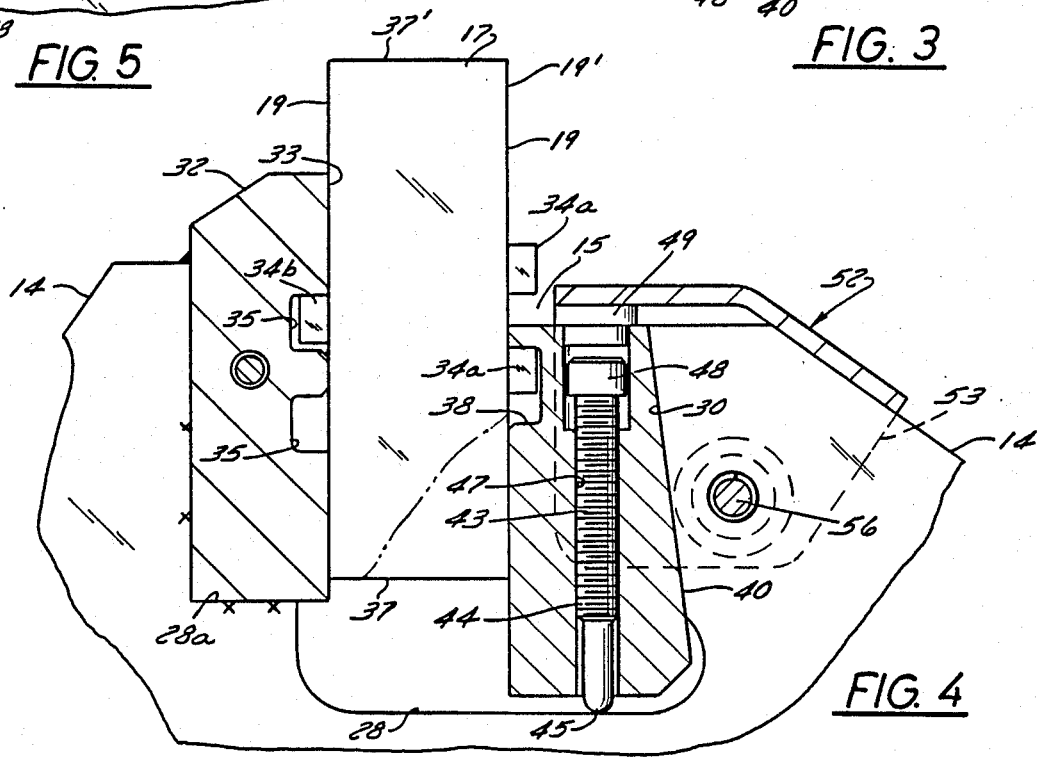
FIG. 4 is a view generally similar to FIG. 2 but showing the hammer bar reversed front-to-rear relative to its FIG. 2 position to project radially to a greater distance beyond the disc periphery.
Figure 6:
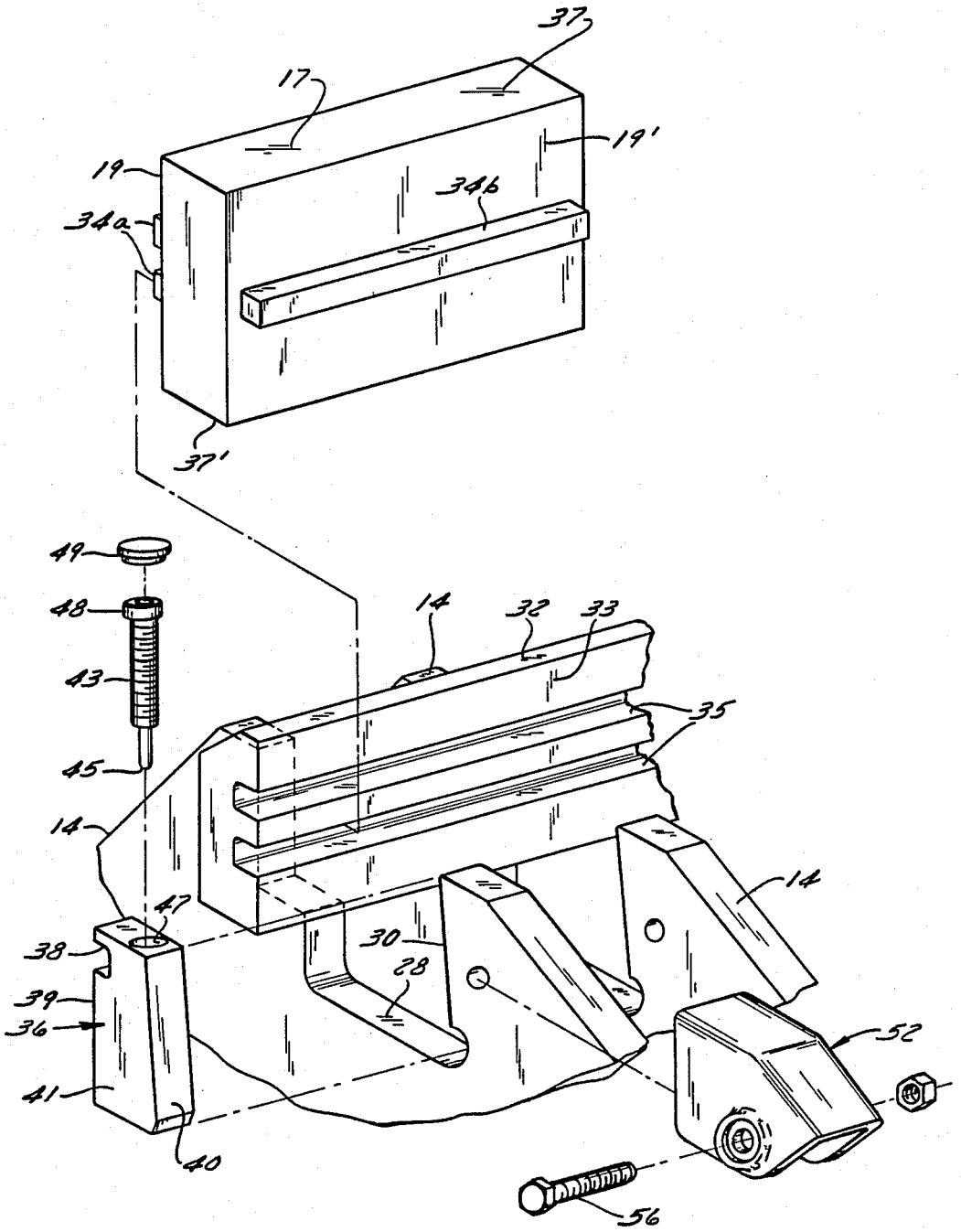
FIG. 6 is a disassembled perspective view of the arrangement shown in FIG. 2.

The several hammer bars 17 of the rotor are all identical, each being of rectangular cross-section to have opposite flat and parallel larger surfaces 19, one of which comprises the impact surface 19' and the other of which serves as a rear surface that is engaged against the flat front surface 33 on the backing bar. Either of these two larger surfaces 19 on each hammer bar can serve as its front surface, and each of the surfaces 19 can provide two alternatively usable impact surfaces 19', owing to the hammer bar being symmetrical with respect to a plane that is parallel to and midway between its flat radially inner and radially outer surfaces 37 and 37', respectively. Thus, when the hammer bar is mounted as shown in FIG. 2, it has two identical ribs 34a projecting from its rear surface that are spaced equal distances to opposite sides of the plane just mentioned and are received in the two grooves 35 in the backing bar, and it has one rib 34b projecting from its front surface that is centered on said plane and is received in a rearwardly opening recess 38 in the wedge 36. The hammer bar can be rotated about its longitudinal axis, from the position shown in FIG. 2 to the position shown in FIG. 4, to exchange the relationship of its front and rear surfaces; and then, with the single rib 34b engaged in the radially outer one of the two grooves 35 in the backing bar while the radially inner one of the twin ribs 34a is received in the recess 38 in the wedge, the hammer bar projects radially to a somewhat greater distance from the rotor axis than in its FIG. 2 position. From either of its positions shown in FIG. 2 and FIG. 4 the hammer bar can be turned end-for-end to bring what had been the radially inner portion of its front surface into position to serve as the radially outwardly projecting impact surface 19'. Thus the hammer bar provides four interchangeable impact surfaces and two different and alternatively selectable positions of radial adjustment.

It will be observed that when a hammer bar 17 is installed, its front surface 19 is substantially radial to the rotor axis while the front confining surface 30 of the disc slot in which it is received is in radially outwardly convergent relation to its front surface. Each wedge 36 is confined between those two obliquely opposing surfaces 19 and 30 and has a radially outward taper that corresponds to their convergence. Thus the wedge has a rear surface 39 that flatwise engages the front surface 19 of the hammer bar and a front surface 40 that similarly engages the front confining surface 30 of the slot. The thickness of each wedge is equal to the axial thickness of a disc, so that the wedge has opposite flat and parallel side surfaces 41 which, with the wedge installed, are flush with the side surfaces 26 of the disc.

For preliminarily establishing each wedge in wedge-locking relationship to a hammer bar there is a screw 43 for the wedge which extends substantially radially in relation to the rotor axis and which has a threaded connection 44 with the wedge and has one end 45 engaged against the bottom surface 28 of the disc slot. In the embodiment of the invention illustrated in FIG. 2, the screw 43 is received in a bore 47 that extends all the way through the wedge, between and parallel to its side surfaces 41 and between its convergent surfaces 39 and 40. The radially inner end portion of this bore 47 is threaded for connection with the screw, while the radially outer end portion of the bore is of enlarged diameter to accommodate the socket head 48 of the screw. Preferably a plug 49 of plastic or the like is removably fitted into the enlarged diameter outer end portion of the bore as a protection for the screw head and the threads of the screw and the bore.

Figure 5:
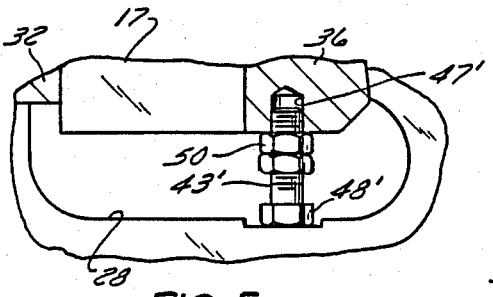
FIG. 5 is a detail view taken on the same plane as FIG. 2 but illustrating a modified embodiment of the invention.
Figure 3:
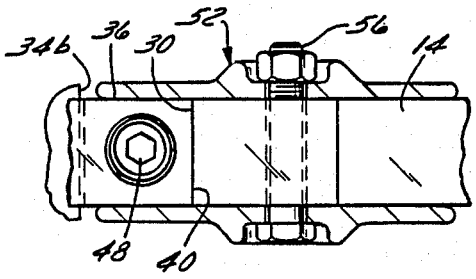
FIG. 3 is a view in section taken on the plane of the line 3—3 in FIG. 2.

In the modified embodiment illustrated in FIG. 5, which is somewhat less expensive than that described above but may be less convenient for hammer bar installation and removal, the screw 45' again has its length substantially radial to the rotor axis, but it is received in a threaded blind bore 47' in the wedge that opens to the wider radially inner end thereof. A hex head 48' on the screw engages against the bottom surface 28 defined by the slot in the disc. If desired, a jam nut 50 on the screw can be tightened against the wider end surface on the wedge. However, it will be apparent that with both embodiments of the invention centrifugal force will force each wedge into tightly wedged engagement with its hammer bar soon after the rotor is first brought up to operating speed, so that any subsequent loosening of the screw 43 or 43' will have no effect upon the security of the hammer bar locking connection.

To confine each wedge to substantially radial motion in its disc slot, the hammer bar connections further comprise a substantially U-shaped shoe 52 for each wedge which is releasably secured to the disc in straddling relation to the peripheral portion thereof and which performs the further function of protecting vulnerable portions of the wedge and the disc. This shoe has rather wide legs 53 which have flat and parallel inner surfaces that overlie the side surfaces 41 of the wedge and also extend across adjacent portions of the side surfaces 26 of the disc in which the wedge is received. The bight portion 55 of the shoe, which rigidly connects its legs 53, overlies the peripheral surface 21 of the disc in a zone in front of the hammer bar, and it also extends at least partway across the radially outer end of the wedge. The shoe 52 is secured to the disc by means of a bolt 56 that extends parallel to the rotor axis through aligned holes in the legs 53 of the shoe and through a bolt hole in the disc that is spaced forwardly from the slot 15. The bolt 56 removably fixes the shoe 52 to the disc but leaves the wedge free to slide radially relative to the shoe as well as relative to the disc.

Figure 7:
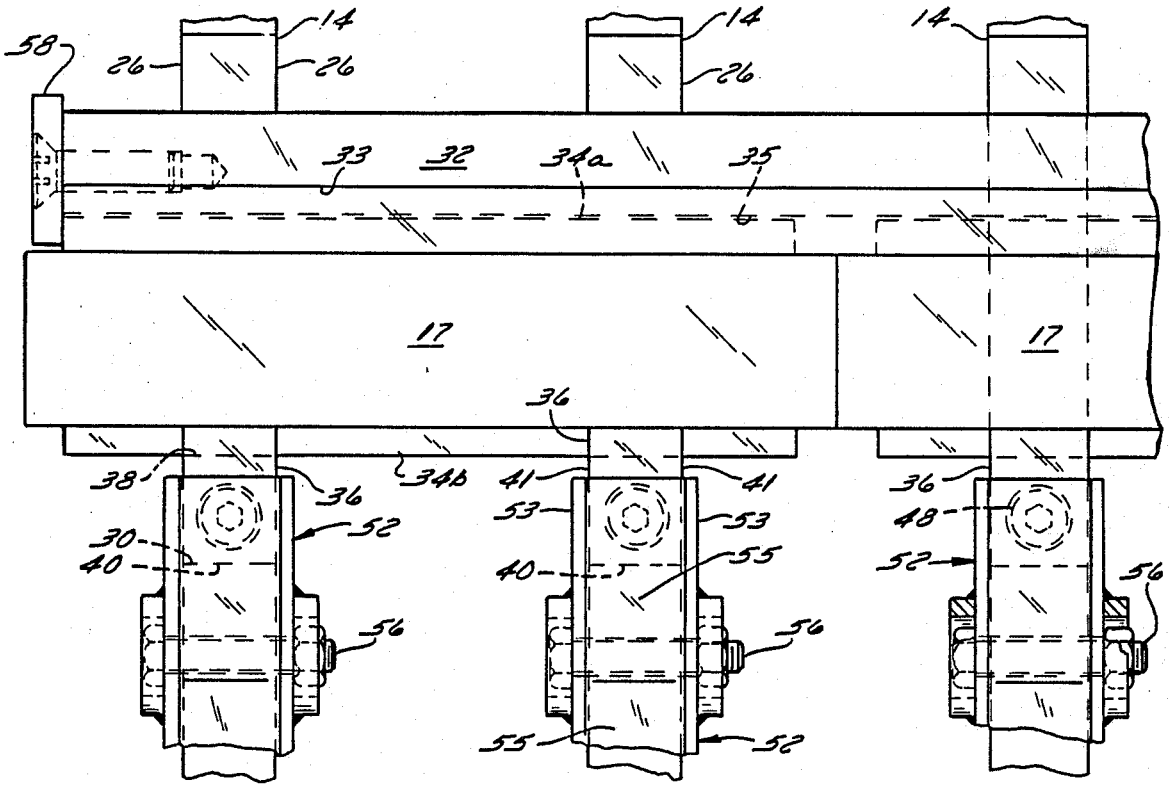
FIG. 7 is a fragmentary view of the rotor as seen from above the same, in the embodiment shown in FIG. 2.
Figure 8:
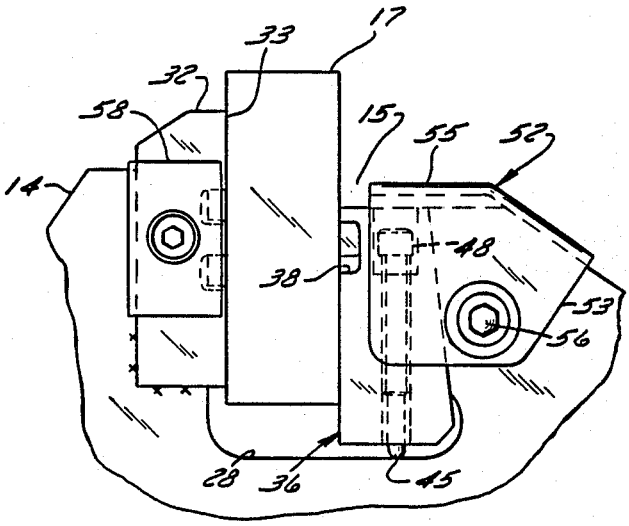
FIG. 8 is a fragmentary view in elevation taken from the left side of FIG. 7.

As best seen in FIG. 7, the rotor here illustrated comprises four discs 14 that are spaced at regular intervals along the shaft 10, and each hammer bar 17 is supported by two of the discs and extends along half the axial length of the rotor, being in endwise abutting relationship with another hammer bar that extends along the other half of the rotor length. The hammer bars are thus relatively small, to be light and compact enough for easy manipulation during installation and removal.

For access to the rotor 9 so that hammer bars can be installed and removed, the housing 5 comprises a relatively fixed portion wherein the inlet 23 is located and which includes the rear wall 24, 24a and the bottom portions of the side walls 6 on which the bearings 11 are mounted; and, as shown in broken lines in FIG. 1, the remainder of the housing is swingable forwardly and upwardly from the fixed portion thereof about a pivot axis 58 which is parallel to the rotor axis and is near the front and the bottom of the housing. It will be understood that the movable portion of the housing is swung between its open and closed positions by hydraulic means or the like (not shown) mounted at the exterior of the housing. The breaker plates 25 are mounted in the movable portion of the housing and are thus accessible when the housing is open. With the housing open, the top portion of the rotor 9 is readily accessible, and installation or removal of a hammer bar will usually be accomplished with the slots that receive it in about the 12 o'clock position.

For installation of a hammer bar, the wedges 36 that cooperate with it are initially out of the disc slots 15 that are to receive it, and the U-shaped shoes 52 that cooperate with those wedges are off of the disc. Hence the hammer bar can be inserted more or less radially into its slot and then moved rearwardly in it to establish the keyed connection between the hammer bar ribs 34a or rib 34b and the appropriate groove or grooves 35 in the backing bar. Each wedge 36 is then inserted into its disc slot by translatory motion parallel to the rotor axis, being brought into the slot near the bottom surface 28 that the slot defines. The shoe 52 is then installed to confine the wedge to radial motion, and thereafter the screw 43 or 43' in the wedge is rotated to drive the wedge radially outward in the slot to a position at which the wedge firmly clamps the hammer bar against the backing bar 32. End plates 58, bolted to the ends of the backing bars 32, engage the axially outer ends of the hammer bar ribs to confine the hammer bars against displacement in directions parallel to the rotor axis, as best seen in FIG. 7.

From the foregoing description taken with the accompanying drawings, it will be apparent that this invention provides an impact crusher rotor having hammer bar securement means providing for quick and easy installation and removal of hammer bars and whereby the hammer bars are detachably locked to the rotor structure in such a manner that their security of attachment is increased by centrifugal force and is not affected by vibration or by loosening of bolts employed to bring them to locked condition when they are initially installed.

What is claimed is:

1. A rotor assembly for an impact crusher comprising: a shaft mounted for rotation in one direction about a rotor axis; at least one disc fixed to the shaft for rotation therewith and which has a peripheral surface, opposite side surfaces normal to said axis and a slot opening substantially radially outwardly to said peripheral surface and defining on the disc a radially outwardly facing bottom surface and opposing front and rear confining surfaces that extend substantially radially outward from said bottom surface; a reversible and radially adjustable elongated hammer bar received in said slot and extending lengthwise parallel to said axis, said hammer bar having a front surface facing substantially in said direction which projects radially outwardly beyond the peripheral surface of the disc to provide a material impacting surface and relative to which the front confining surface on the disc is in obliquely opposing and radially outwardly convergent relationship; first cooperating key means on the disc at the rear confining surface of the slot and on the rear of the hammer bar providing radially oppositely facing abutments opposingly engageable to confine the hammer bar against radially outward displacement relative to the disc; a radially outwardly tapering wedge in said slot which is confined between said front surface of the hammer bar and said front confining surface on the disc; second cooperating key means on the front of the hammer bar and on a side of the wedge facing the front of the hammer bar providing radially oppositely facing abutments opposingly engageable to further confine the hammer bar against radially outward displacement relative to the disc; said wedge cooperating with said first and second key means to releasably lock the hammer bar to the disc; and a screw extending lengthwise substantially radially to said rotor axis, said screw (a) having one end rotatably engaging said bottom surface on the disc to react against the same and (b) having a threaded connection with said wedge whereby rotation of the screw in one direction drives the wedge radially outwardly in the slot and thus into confining engagement with the hammer bar whereas its rotation in the opposite direction provides for release of the hammer bar for removal thereof from the slot.

2. The rotor assembly of claim 1 wherein said wedge has opposite side surfaces which are substantially flush with said side surfaces on the disc, further characterized by:

(1) a substantially U-shaped shoe having (a) a pair of opposite legs which flatwise overlie said side surfaces of the disc and of the wedge to confine the wedge against displacement relative to the disc in directions parallel to said rotor axis and (b) a bight portion by which said legs are connected and which protectively overlies said peripheral surface of the disc in a zone thereof that is in front of said front surface of the hammer bar; and (2) securement means engaged with the disc and with said legs of the shoe, for releasably fixing the shoe to the disc.

3. The rotor assembly of claim 1 wherein said wedge has a bore therethrough, at least a portion of which is threaded and wherein said screw is received, and wherein said screw has an opposite end portion which is accessible at the radially outer end portion of said bore and which is engageable for rotation of the screw.

4. In an impact crusher rotor assembly: a shaft mounted for rotation in one direction about a rotor axis; a plurality of discs fixed to the shaft at axially spaced intervals along it for rotation with it, each having opposite side surfaces normal to said axis, a peripheral surface and a plurality of slots, each of which slots opens substantially radially outwardly to the peripheral surface of the disc and defines on the disc a radially outwardly facing bottom edge surface and opposing front and rear confining surfaces that extend substantially radially outwardly from said bottom edge surface; a reversible and radially adjustable elongated hammer bar receives in each said slot in each disc and extending lengthwise parallel to the rotor axis, said hammer bar having a rear surface confronting the rear confining surface of the slot and having a front surface which faces substantially in said direction and projects radially outwardly beyond the peripheral surface of the disc and relative to which the front confining surface defined by the slot is in obliquely opposing and radially outwardly convergent relationship; and means for releasably fixing the hammer bar to said discs comprising for each slot of each disc:

a. a wedge received in the slot and having (1) opposite flat and parallel side surfaces that are substantially flush with said side surfaces of the disc and (2) opposite wedging surfaces for respectively engaging said front surface of the hammer bar and said front confining surface on the disc;

b. a substantially U-shaped shoe detachably fixed to the disc and having (1) a bight portion protectively overlying said peripheral surface of the disc in a zone thereof which is in front of said front surface of the hammer bar and (2) a pair of opposite legs which extend radially inwardly from said bight portion and which have flat and parallel opposing inner surfaces that flatwise slidably overlie said side surfaces of the wedge and of the disc to confine the wedge to substantially radial displacement relative to the disc and the shoe, towards and from said bottom edge surface;

c. a screw (1) having a threaded connection with said wedge, (2) extending substantially radially in relation to the rotor axis and (3) having a radially inner end disposed for reaction against said bottom edge surface defined by the slot, so that said screw, upon being rotated in one direction, cooperates with said threaded connection and said bottom edge surface to drive the wedge radially outwardly in the slot;

d. first cooperating key means on the disc at the rear confining surface of the slot and on the rear surface of the hammer bar; and e. second cooperating key means on the front surface of the hammer bar and on the wedging surface of the wedge which engages the front surface of the hammer bar.

5. The impact crusher rotor assembly of claim 4, further characterized by:

(1) said wedge having a bore extending radially therethrough, between its wedging surfaces and between and parallel to its side surfaces, wherein said screw is received, (2) said screw having at a radially outer end thereof a head which is near a radially outer end of said bore and by which the screw can be rotated.

6. The impact crusher rotor assembly of claim 4 wherein said shoe is detachably fixed to the disc by means of a bolt which has its length substantially parallel to said rotor axis and which extends through aligned holes in said legs of the shoe and through a hole in the disc that is spaced in said direction of rotation from the slot.

7. In an impact crusher rotor assembly:

a rotatable shaft having an axis of rotation;

a plurality of discs mounted on and rotatable with said shaft and axially spaced apart from each other;

each disc have a slot extending radially inwardly from the circumferential edge of said disc and defined by a rear side, a front side and a bottom side;

a reversible and adjustably positionable hammer bar disposed in said slot and having a rear surface and a front surface;

and means for releasably and adjustably securing said hammer bar in said slot and comprising:

a wedge disposed in said slot between said front surface of said hammer bar and said front side of said slot, said wedge having a rear side and having a threaded hole therethrough;

first interengageable means connected between said rear surface of said hammer bar and said rear side of said slot;

second interengageable means connected between said front surface of said hammer bar and said rear side of said wedge;

each of said first and second interengageable means comprising a projection and a recess for receiving and engaging said projection to prevent radially outward movement of said hammer bar relative to said slot;

and an adjustably rotatable threaded member in threaded engagement with said threaded hole in said wedge and in engagement with said bottom side of said slot to adjustably position said wedge in said slot.

8. A rotor assembly according to claim 7 further including means releasably engaged with said disc and said wedge to prevent axial movement of said wedge relative to said disc.

* * * * *